US011480339B2

(12) United States Patent
Taniguchi et al.

(10) Patent No.: US 11,480,339 B2
(45) Date of Patent: Oct. 25, 2022

(54) COMBUSTOR FOR GAS TURBINE AND GAS TURBINE HAVING THE SAME

(71) Applicant: Mitsubishi Power, Ltd., Kanagawa (JP)

(72) Inventors: Kenta Taniguchi, Yokohama (JP); Kiyoshi Fujimoto, Yokohama (JP); Tatsuya Kowari, Yokohama (JP); Ryota Fukuoka, Nagasaki (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/290,356

(22) PCT Filed: Nov. 13, 2019

(86) PCT No.: PCT/JP2019/044543
§ 371 (c)(1),
(2) Date: Apr. 30, 2021

(87) PCT Pub. No.: WO2020/116113
PCT Pub. Date: Jun. 11, 2020

(65) Prior Publication Data

US 2022/0010961 A1 Jan. 13, 2022

(30) Foreign Application Priority Data

Dec. 3, 2018 (JP) ..... JP2018-226203

(51) Int. Cl.
*F23R 3/28* (2006.01)
*F23R 3/34* (2006.01)

(52) U.S. Cl.
CPC ..... *F23R 3/28* (2013.01); *F23R 3/286* (2013.01); *F23R 3/346* (2013.01)

(58) Field of Classification Search
CPC .. F23R 3/28; F23R 3/283; F23R 3/286; F23R 3/34; F23R 3/343; F23R 3/346; F23R 3/46
See application file for complete search history.

(56) References Cited

U.S. PATENT DOCUMENTS 6,360,776 B1 3/2002 McCormick et al.
2009/0100837 A1 4/2009 Von Der Bank
(Continued)

FOREIGN PATENT DOCUMENTS

CN 107869392 4/2018
JP 4-15409 1/1992
(Continued)

OTHER PUBLICATIONS

International Search Report dated Jan. 7, 2020 in International Application No. PCT/JP2019/044543, with English language translation.
(Continued)

*Primary Examiner* — William H Rodriguez
(74) *Attorney, Agent, or Firm* — Wenderoth, Lind & Ponack, L.L.P.

(57) ABSTRACT

A combustor for a gas turbine includes: a flange portion to be mounted to a casing; an extension portion having an annular shape and extending from the flange portion along an axial direction of the combustor; a pipe portion having a first end connected to the flange portion and a second end connected to an outer peripheral surface of the extension portion, the pipe portion extending from the first end to the second end at an outer side of the extension portion in a radial direction; and at least one fuel nozzle configured to receive supply of a fuel via the pipe portion and a passage disposed inside the extension portion.

16 Claims, 9 Drawing Sheets

(56) References Cited

U.S. PATENT DOCUMENTS

| | | | | |
|---|---|---|---|---|
| 2010/0115966 | A1 | 5/2010 | Nagai et al. | |
| 2010/0154424 | A1* | 6/2010 | Twardochleb | F23R 3/36 60/740 |
| 2011/0239619 | A1* | 10/2011 | Omae | F02C 9/40 60/39.08 |
| 2013/0025283 | A1* | 1/2013 | Berry | F23R 3/286 60/737 |
| 2016/0245182 | A1* | 8/2016 | Elwasila | F02C 7/22 |
| 2017/0122566 | A1* | 5/2017 | Piersail | F02C 7/222 |
| 2018/0087776 | A1 | 3/2018 | Flanagan et al. | |
| 2018/0187607 | A1* | 7/2018 | Hughes | F23R 3/002 |
| 2018/0187893 | A1* | 7/2018 | DiCintio | F23R 3/10 |
| 2018/0328587 | A1* | 11/2018 | Gubba | F23R 3/286 |
| 2019/0056111 | A1 | 2/2019 | Miyamoto et al. | |
| 2019/0086093 | A1* | 3/2019 | Fukuba | F23R 3/14 |
| 2020/0191395 | A1* | 6/2020 | Di Norscia | F23R 3/343 |
| 2021/0404660 | A1* | 12/2021 | Godfrey | F23R 3/286 |
| 2022/0026069 | A1* | 1/2022 | Paniharam | F02C 7/222 |

FOREIGN PATENT DOCUMENTS

| | | |
|---|---|---|
| JP | 8-135970 | 5/1996 |
| JP | 9-184629 | 7/1997 |
| JP | 10-238776 | 9/1998 |
| JP | 2008-25910 | 2/2008 |
| JP | 2008-261605 | 10/2008 |
| JP | 2012-154588 | 8/2012 |
| JP | 2016-156376 | 9/2016 |
| JP | 107869392 | 4/2018 |

OTHER PUBLICATIONS

International Preliminary Report on Patentability dated Jun. 17, 2021 in International Application No. PCT/JP2019/044543, with English language translation.

Office Action dated Mar. 5, 2019 in Japanese Patent Application No. 2018-226203, with English-language translation.

Office Action dated Mar. 24, 2022 in counterpart CN Application No. 201980072683.2.

* cited by examiner

COMBUSTOR FOR GAS TURBINE AND GAS TURBINE HAVING THE SAME

TECHNICAL FIELD

The present disclosure relates to a combustor for a gas turbine and a gas turbine having the same.

BACKGROUND ART

The temperature of a combustor of a gas turbine increases during operation of the gas turbine, which may cause heat expansion of constituent members of the combustor. When stress concentration occurs in the combustor due to such heat expansion, the lifetime of the combustor may become short. Thus, measures have been taken to mitigate stress concentration that may occur in combustors.

For instance, Patent Document 1 discloses a gas turbine provided with a cylindrical ring member that forms a fuel passage in communication with a fuel nozzle (top hat nozzle) for injecting a fuel to a flow of compressed air, as a constituent member of the external cylinder. The ring member has, in a partial region in the axial direction of the combustor, a thin portion whose thickness is relatively thin. Accordingly, the stiffness of the ring is member is partially reduced to allow deformation at the time of heat expansion of the ring member, thereby reducing stress that occurs at the welding part that connects the ring member and the member adjacent to the ring member.

CITATION LIST

Patent Literature

Patent Document 1: JP2008-261605A

SUMMARY

Problems to be Solved

As for the gas turbine combustor disclosed in Patent Document 1, the thin portion is disposed in an area where the fuel passage is formed inside the external cylinder of the combustor and thus the structure is complicated, which may lead to an increase in the machining cost of the thin portion.

In view of the above, an object of at least one embodiment of the present invention is to provide a combustor for a gas turbine and a gas turbine having the same, capable of mitigating stress concentration due to heat expansion with a simple configuration.

Solution to the Problems (1) According to at least one embodiment of the present invention, a combustor for a gas turbine includes: a flange portion to be mounted to a casing; an extension portion having an annular shape and extending from the flange portion along an axial direction of the combustor; a pipe portion having a first end connected to the flange portion and a second end connected to an outer peripheral surface of the extension portion, the pipe portion extending from the first end to the second end at an outer side of the extension portion in a radial direction; and at least one fuel nozzle configured to receive supply of a fuel via the pipe portion and a passage disposed inside the extension portion.

With the above configuration (1), the fuel is supplied to the fuel nozzle via the pipe portion connected to the flange portion and the extension portion, and thus it is possible to reduce stress applied to the connection part between the pipe portion and the extension portion even when stress is generated at the above described connection part due to different heat expansion amounts between the pipe portion and the extension portion during operation of the gas turbine, because the pipe portion is relatively easily deformable. Thus, in the combustor of the gas turbine, it is possible to mitigate stress concentration due to heat expansion, with a simple configuration in which the pipe portion connected to the flange portion and the extension portion is provided. Accordingly, it is possible to reduce the machining cost and extend the lifetime of the combustor.

(2) In some embodiments, in the above configuration (1), the passage includes an annular passage communicating with an inner flow passage of the pipe portion, and the combustor is configured such that the fuel is supplied to a plurality of the fuel nozzles via the annular passage.

With the above configuration (2), it is possible to mitigate stress concentration due to the difference in the heat expansion amounts between the pipe portion and the extension portion as described in the above (1), while supplying the fuel to the plurality of fuel nozzles via the annular passage disposed on the extension portion.

(3) In some embodiments, in the above configuration (1) or (2), the at least one fuel nozzle is disposed at an inner peripheral side of the extension portion.

With the above configuration (3), the fuel nozzle is disposed at the inner peripheral side of the extension portion, and thus it is possible to mitigate stress concentration due to the difference in the heat expansion amounts between the pipe portion and the extension portion as described in the above (1), while having a configuration in which the fuel from the pipe portion disposed at the outer peripheral side of the extension portion is transferred through the inside of the extension portion from the outer peripheral side toward the inner peripheral side of the extension portion and supplied to the fuel nozzle.

(4) In some embodiments, in any one of the above configurations (1) to (3), the pipe portion includes: an axial-direction pipe portion including the first end and extending along the axial direction of the combustor; a radial-direction pipe portion including the second end and extending along a radial direction of the combustor; and a connection pipe portion connecting the axial-direction pipe portion and the radial-direction pipe portion. The pipe portion has a length L including the connection pipe portion, the length L being larger than a sum of $L_A$ and $L_B$, where $L_A$ is an axial-direction distance between the first end and the second end and $L_B$ is a radial-direction distance between the first end and the second end.

With the above configuration (4), the entire length L of the pipe portion is larger than the sum of the axial-direction distance $L_A$ and the radial-direction distance $L_B$, and thus the pipe portion has a bend shape between the axial-direction pipe portion connected to the flange and the radial-direction pipe portion connected to the extension portion. Since the pipe portion having such a bend shape is flexibly deformable, it is possible to effectively reduce stress generated at the connection part between the pipe portion and the extension portion due to the difference in the heat expansion amounts between the pipe portion and the extension portion.

(5) In some embodiments, in any one of the above configurations (1) to (4), the first end and the second end of the pipe portion are positioned offset from one another in a circumferential direction of the combustor.

With the above configuration (5), the first end and the second end of the pipe portion are positioned offset in the circumferential direction, and thus the pipe portion has a portion that extends along the circumferential direction between the first end and the second end. Thus, it is possible to allow the pipe portion to deform flexibly without increasing the entire length of the pipe portion excessively, which makes it is possible to effectively reduce stress generated at the connection part between the pipe portion and the extension portion due to the difference in the heat expansion amounts between the pipe portion and the extension portion.

(6) In some embodiments, in any one of the above configurations (1) to (5), the pipe portion is disposed inside a space surrounded by the casing at an outer peripheral side of the extension portion.

With the above configuration (6), the pipe portion is connected to the flange portion and the extension portion inside the space surrounded by the casing, and thus it is possible to realize the above configuration (1) with a more simplified structure.

(7) In some embodiments, in any one of the above configurations (1) to (6), the combustor for a gas turbine further includes a fuel supply pipe connected to an end surface opposite to the pipe portion, the end surface being one of two opposite end surfaces of the flange portion. The combustor is configured such that the fuel is supplied to the annular passage via the fuel supply pipe, a flange internal passage disposed inside the flange portion, and the pipe portion.

With the above configuration (7), the fuel supply pipe is provided, and thus it is possible to supply the fuel to the fuel nozzle smoothly via the fuel supply pipe and the flange internal passage from outside the casing of the combustor.

(8) In some embodiments, in the above configuration (7), the fuel supply pipe, the flange internal passage, and the first end of the pipe portion are disposed along a line substantially parallel to the axial direction of the combustor.

With the above configuration (8), the fuel supply pipe, the flange internal passage, and the fuel passage including a part of the pipe portion at the side of the first end are arranged linearly, and thus it is possible to transfer the fuel via the above fuel passages smoothly. Furthermore, the flange internal passage extends along the axial direction, and thus the temperature distribution in the thickness direction of the flange portion becomes substantially uniform. Thus, it is possible to reduce thermal stress that may occur due to temperature distribution at the flange portion.

(9) In some embodiments, in any one of the above configurations (1) to (8), the fuel nozzle is formed inside the casing, and configured to inject a fuel into an air passage through which air to be used in combustion of the fuel passes.

In a typical combustor, an air passage is disposed at the relatively outer peripheral side, in the internal space of the casing of the combustor. That is, the air passage and the fuel nozzle for supplying the fuel to the air passage are positioned relatively close to the flange portion fixed to the casing, in the radial direction of the combustor. In this regard, with the above configuration (9), it is possible to supply the fuel to the fuel nozzle positioned relatively close to the flange portion via the pipe portion connected to the flange portion, and thus it is possible to simplify the fuel supply path to the third fuel nozzle and supply the fuel to the fuel nozzle smoothly.

(10) In some embodiments, in the above configuration (9), the extension portion includes an air-passage forming portion which forms the air passage at an opposite side of the flange portion across the pipe portion in the axial direction.

With the above configuration (10), the air passage is formed by a part of the extension portion, and thereby the fuel nozzle is disposed close to the extension portion. Thus, it is possible to supply the fuel to the fuel nozzle smoothly via the passage formed inside the extension portion.

(11) According to at least one embodiment of the present invention, a combustor for a gas turbine includes: a flange portion to be mounted to a casing; an extension portion having an annular shape and extending from the flange portion along an axial direction of the combustor; at least one fuel nozzle configured to receive supply of a fuel via a passage disposed inside the extension portion; and a fuel supply pipe for supplying the fuel to the passage, the fuel supply pipe being connected to the flange portion. The flange portion has, in a first angular range around a center axis of the combustor, a first region whose protruding amount outward in a radial direction is greater than that in a second angular-range other than the first angular range. The fuel supply pipe is connected to a portion of the flange portion including the first region.

With the above configuration (11), the flange portion has the first region with a relatively large protruding amount and the fuel supply pipe is connected to the first region. Thus, it is possible to suppress an increase in the outer diameter of the gas turbine during transportation of the gas turbine, compared to a case where the fuel is supplied to the flange internal passage or the passage inside the extension portion via the pipe or the like disposed at the outer side of the flange portion in the radial direction, such as, a case where the fuel supply pipe needs to be connected to the outer rim portion of the flange portion. Furthermore, by providing the first region with a large protruding amount, it is possible to connect the fuel supply pipe to the flange portion without interfering with constituent members which may be disposed at the inner side of the combustor in the radial direction (where the protruding amount of the flange portion is not increased). Thus, it is possible to avoid interference between the fuel supply pipe and other members without increasing the outer diameter of the gas turbine.

(12) According to at least one embodiment of the present invention, a gas turbine includes: the combustor according to any one of the above (1) to (12); and a stator vane and a rotor blade disposed at a downstream side of the combustor.

With the above configuration (12), the fuel is supplied to the third fuel nozzle via the pipe portion connected to the flange portion and the extension portion, and thus it is possible to reduce stress applied to the connection part between the pipe portion and the extension portion even when stress is generated at the above described connection part due to difference in the heat expansion amounts between the pipe portion and the extension portion during operation of the gas turbine, because the pipe portion is relatively easily deformable. Thus, in the combustor of the gas turbine, it is possible to mitigate stress concentration due to heat expansion, with a simple configuration in which the pipe portion is connected to the flange portion and the extension portion. Accordingly, it is possible to reduce the machining cost and extend the lifetime of the combustor.

(13) According to at least one embodiment of the present invention, a gas turbine includes: the combustor according to the above (11); and a stator vane and a rotor blade disposed at a downstream side of the combustor. The first region of the flange portion is disposed at a position farther away from a center axis of the gas turbine than the center axis of the combustor.

With the above configuration (13), of the flange portion, the first region having a relatively large protruding amount is positioned at the outer side of the gas turbine in the radial direction, and thus it is possible to effectively suppress an increase in the outer diameter of the gas turbine during transportation of the gas turbine. Thus, it is possible to avoid interference between the fuel supply pipe and other members without increasing the outer diameter of the gas turbine.

Advantageous Effects

According to at least one embodiment of the present invention, it is possible to provide a combustor for a gas turbine and a gas turbine having the same capable of mitigating stress concentration due to heat expansion with a simple configuration.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
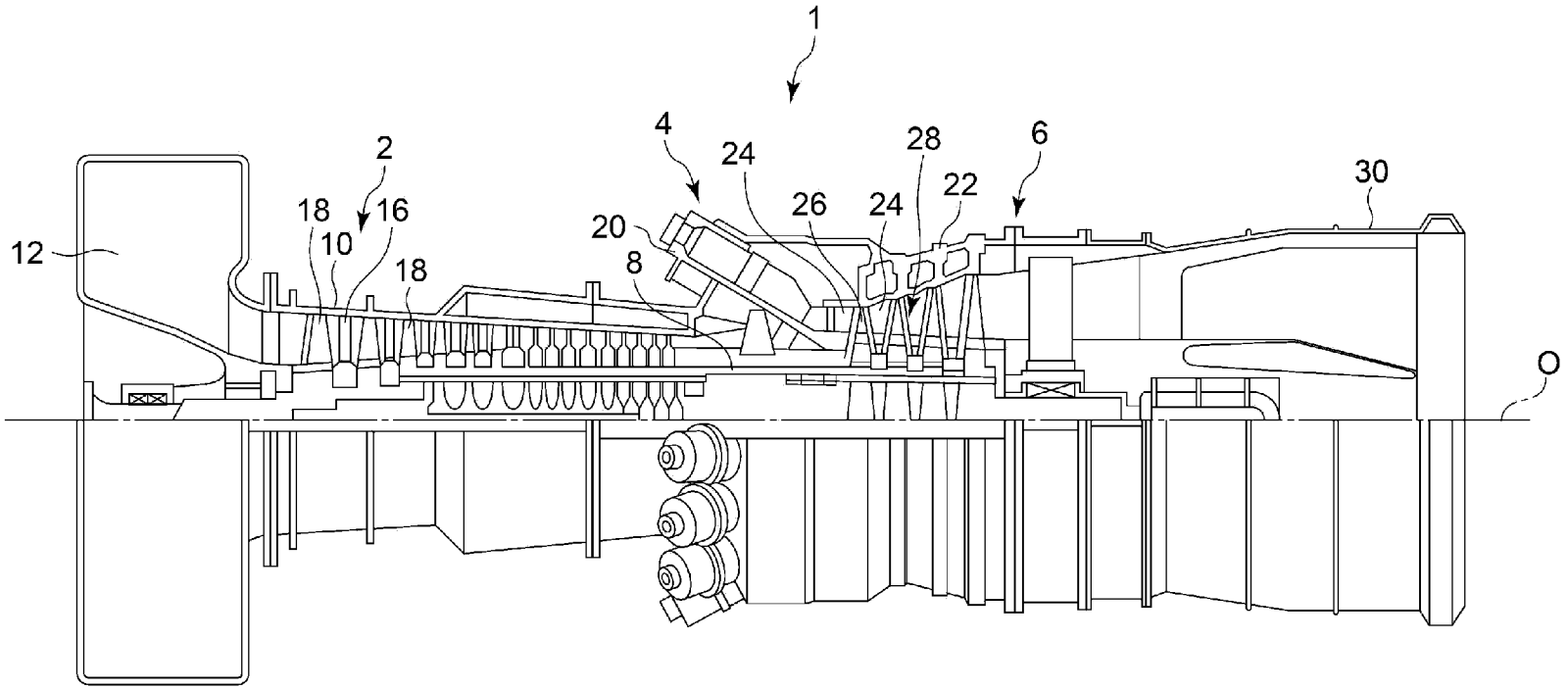
FIG. 1 is a schematic configuration diagram of a gas turbine according to an embodiment.

First, with reference to FIG. 1, a gas turbine, which is an example of application of a combustor according to some embodiments, will be described. FIG. 1 is a schematic configuration diagram of a gas turbine according to an embodiment.

As depicted in FIG. 1, the gas turbine 1 includes a compressor 2 for producing compressed air, a combustor 4 for producing combustion gas from the compressed air and a fuel, and a turbine 6 configured to be rotary driven by combustion gas. In the case of the gas turbine 1 for power generation, a generator (not depicted) is connected to the turbine 6.

The compressor 2 includes a plurality of stator vanes 16 fixed to the side of the compressor casing 10 and a plurality of rotor blades 18 disposed on the rotor 8 so as to be arranged alternately with the stator vanes 16.

The compressor 2 is supplied with air taken in from an air inlet 12, and the air flows through the plurality of stator vanes 16 and the plurality of rotor blades 18 to be compressed and become compressed air having a high temperature and a high pressure.

The combustor 4 is supplied with a fuel and the compressed air produced in the compressor 2. The fuel is combusted in the combustor, and thereby combustion gas that serves as a working fluid of the turbine 6 is produced. As depicted in FIG. 1, the gas turbine 1 includes a plurality of combustors 4 arranged along the circumferential direction around the rotor 8 inside the casing 20.

The turbine 6 has a combustion gas passage 28 formed by a turbine casing 22, and includes a plurality of stator vanes 24 and a plurality of rotor blades 26 disposed in the combustion gas passage 28. The stator vanes 24 and the rotor blades 26 of the turbine 6 are disposed downstream of the combustors 4, with respect to the flow of combustion gas.

The stator vanes 24 are fixed to the side of the turbine casing 22, and a plurality of stator vanes 24 arranged along the circumferential direction of the rotor 8 form a stator vane row. Furthermore, the rotor blades 26 are disposed on the rotor 8, and a plurality of rotor blades 26 arranged along the circumferential direction of the rotor 8 form a rotor blade row. The rotor rows and the vane rows are arranged alternately in the axial direction of the rotor 8.

In the turbine 6, the rotor 8 is rotary driven by combustion gas from the combustor 4 flowing into the combustion gas passage 28 and passing through the plurality of stator vanes 24 and the plurality of rotor blades 26, and thereby a generator coupled to the rotor 8 is driven and electric power is generated. The combustion gas having driven the turbine 6 is discharged outside via an exhaust chamber 30.

Next, the combustor 4 according to some embodiments will be described.

Figure 2:
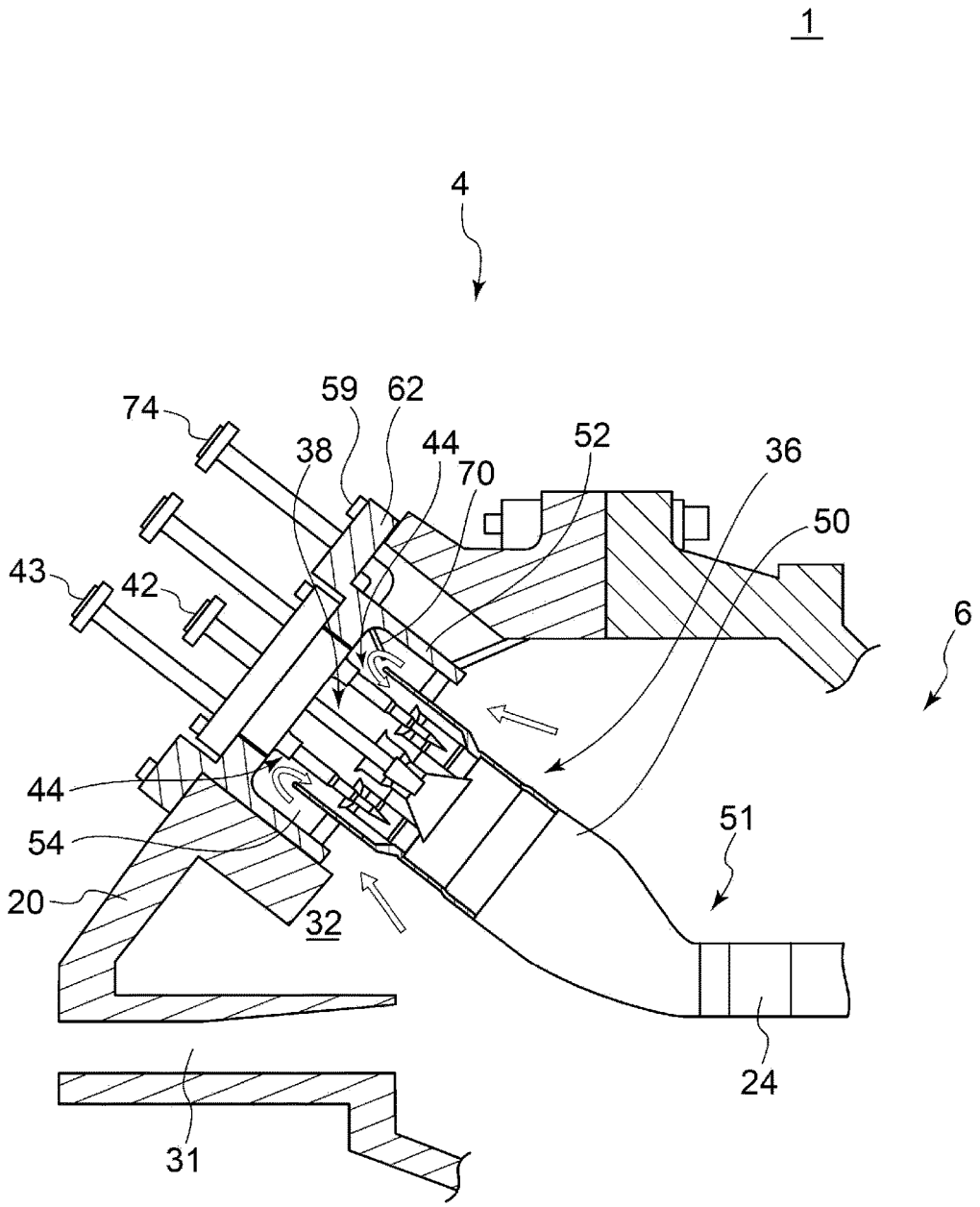
FIG. 2 is a schematic configuration diagram of a combustor of a gas turbine and an inlet portion of a turbine according to an embodiment.
Figure 3:
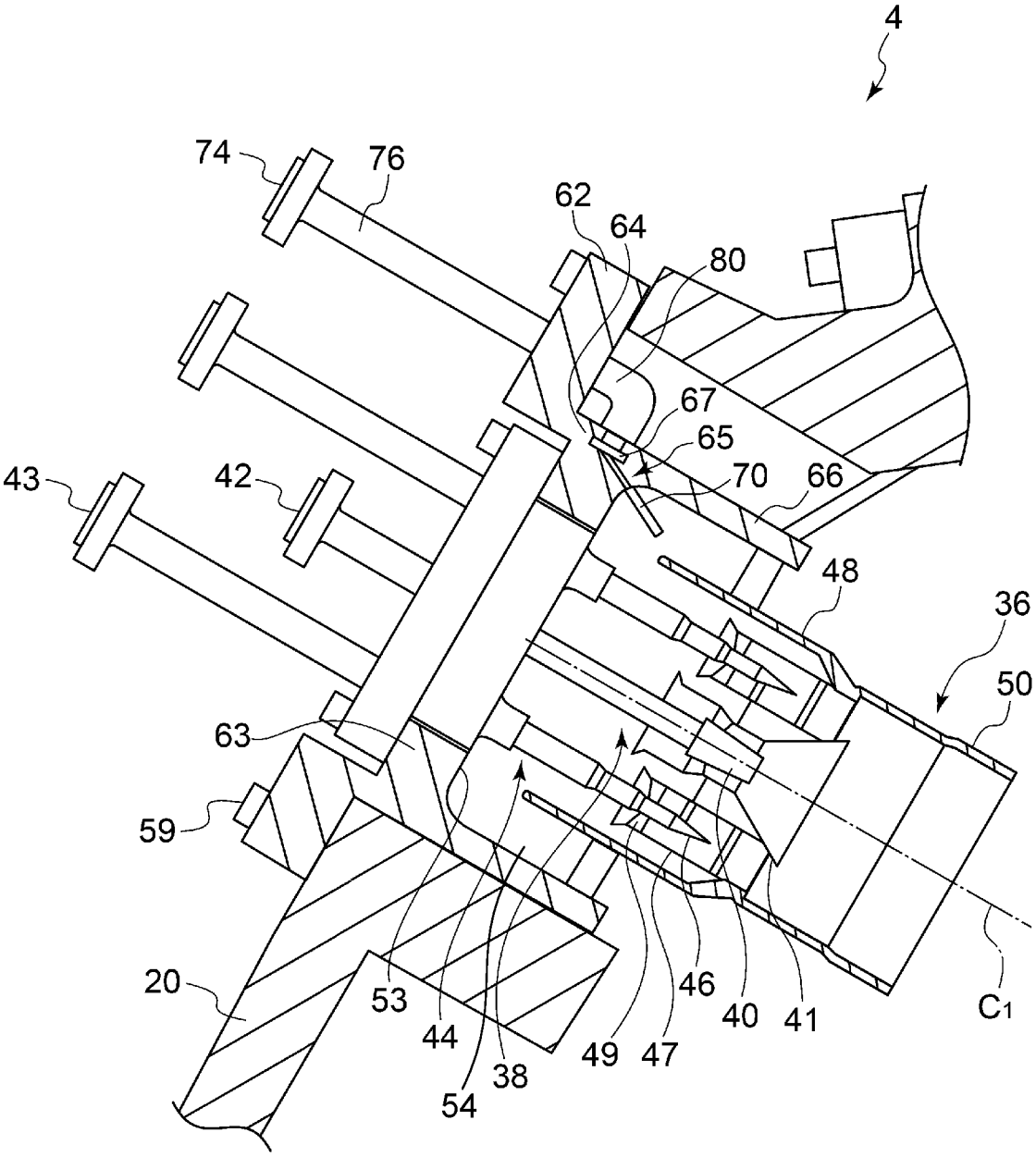
FIG. 3 is a schematic cross-sectional view of the combustor depicted in FIG. 2.

FIG. 2 is a schematic configuration diagram of the combustor 4 of the gas turbine 1 and an inlet portion of the turbine 6 according to an embodiment. FIG. 3 is a schematic cross-sectional view of the combustor 4 depicted in FIG. 2.

As depicted in FIGS. 2 and 3, a plurality of combustors 4 are arranged in the circumferential direction around the rotor 8 (see FIG. 1), and each combustor 4 includes a combustion cylinder (combustor liner) 36 disposed in a combustor casing 32 defined by the casing 20, a first combustion burner 38 and a plurality of second combustion burners 44 disposed so as to surround the first combustion burner 38, each disposed in the combustion cylinder (combustor liner) 36. That is, the combustion cylinder 36, the first combustion burner 38, and the second combustion burners 44 are accommodated in the casing 20.

The combustion cylinder (combustor liner) 36 includes a combustor basket 48 disposed around the first combustion burner 38 and the plurality of second combustion burners 44, and a transition piece 50 connected to a tip portion of the combustor basket 48. The combustor basket 48 and the transition piece 50 may be formed integrally.

The first combustion burner 38 is disposed along the direction of the center axis $C_1$ of the combustion cylinder 36 (i.e., the axial direction of the combustor 4; hereinafter, also referred to as merely "axial direction"), and includes the first fuel nozzle 40 for injecting a fuel and the first burner cylinder 41 disposed so as to surround the first fuel nozzle 40. The first fuel nozzle 40 is supplied with the fuel via the first fuel port 42.

The second combustion burner 44 includes the second fuel nozzle 46 for injecting a fuel and the second burner cylinder 47 disposed so as to surround the second fuel nozzle 46. The second fuel nozzle 46 is supplied with the fuel via the second fuel port 43.

The combustor 4 further includes an external cylinder 52 disposed at the radially outer side of the combustor basket 48 inside the casing 20. At the outer peripheral side of the combustor basket 48 and the inner peripheral side of the external cylinder 52, an air passage 54 through which compressed air flows is formed.

The compressed air produced in the compressor 2 (see FIG. 1) is supplied to the inside of the combustor casing 32 via the casing inlet 31, and flows into the air passage 54 from the combustor casing 32, then changes its direction at a wall surface portion 53 disposed along the surface orthogonal to the axial direction of the combustor 4 and flows into the first burner cylinder 41 and the second burner cylinder 47. In each burner cylinder, the fuel injected from the fuel nozzle and compressed air are mixed, and the gas mixture flows into the combustion cylinder 36 to be ignited and combusted. Accordingly, combustion gas is produced.

The first combustion burner 38 described above may be a burner for generating a diffusion combustion flame, and the second combustion burner 44 may be a burner for combusting a pre-mixed gas and generating a pre-mixed combustion flame.

That is, in the second combustion burner 44, the fuel from the second fuel port 43 and the compressed air are pre-mixed, and the pre-mixed gas is formed mainly into a swirl flow by a swirler 49, and flows into the combustion cylinder 36. Further, the compressed air and the fuel injected from the first combustion burner 38 via the first fuel port 42 are mixed in the combustion cylinder 36, and ignited by an ignition unit (not depicted) to be combusted, whereby combustion gas is generated. At this time, a part of the combustion gas diffuses to the surroundings with flames, which ignites the pre-mixed gas flowing into the combustion cylinder 36 from each of the second combustion burners 44 to cause combustion. That is, with the diffusion combustion flames produced by the fuel injected from the first combustion burner 38, it is possible to hold flames for performing stable combustion of pre-mixed gas (premixed fuel) from the second combustion burners 44.

The combustion gas produced through combustion of the fuel in the combustor 4 as described above flows into the turbine 6 via an outlet portion 51 of the combustor 4 positioned at the downstream end portion of the transition piece 50.

The combustor 4 includes the third fuel nozzle 70 for injecting a fuel into the above described air passage 54. A plurality of third fuel nozzles 70 may be disposed along the circumferential direction of the combustor (hereinafter, also referred to as merely "circumferential direction").

When the third fuel nozzle 70 injects the fuel into the air passage 54, the injected fuel mixes with the compressed air flowing into the air passage 54, and the fuel-gas mixture flows into each burner cylinder. Further, by injecting the fuel to the fuel gas mixture from the above described first fuel nozzle 40 and the second fuel nozzles 46 to generate a gas mixture, it is possible to generate a uniform fuel-gas mixture and reduce Nox.

The combustor 4 may include other constituent members such as a bypass line (not depicted) for allowing the combustion gas to bypass.

Next, the combustor 4 according to some embodiments will be described in more detail.

While the following description illustrates an embodiment where the "fuel nozzle" of the present invention is the above described third fuel nozzle 70, the "fuel nozzle" of the present invention may be a fuel nozzle other than the third fuel nozzle 70, such as the first fuel nozzle 40 or the second fuel nozzle 46 described above.

Figure 4:
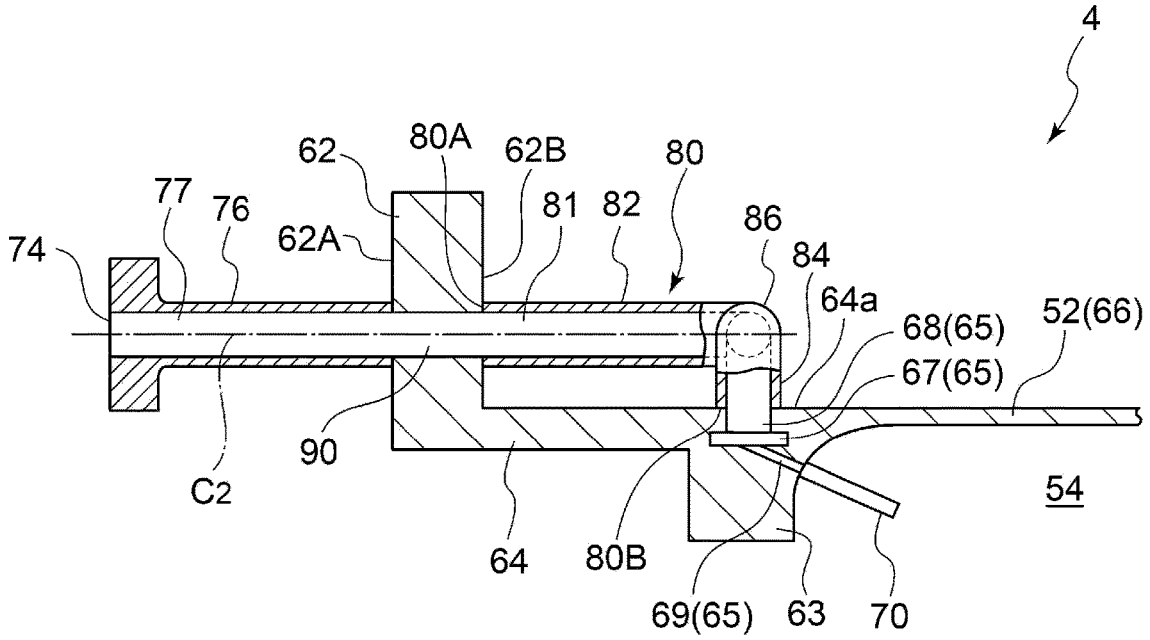
FIG. 4 is a partial cross-sectional view of a combustor according to an embodiment.
Figure 5:
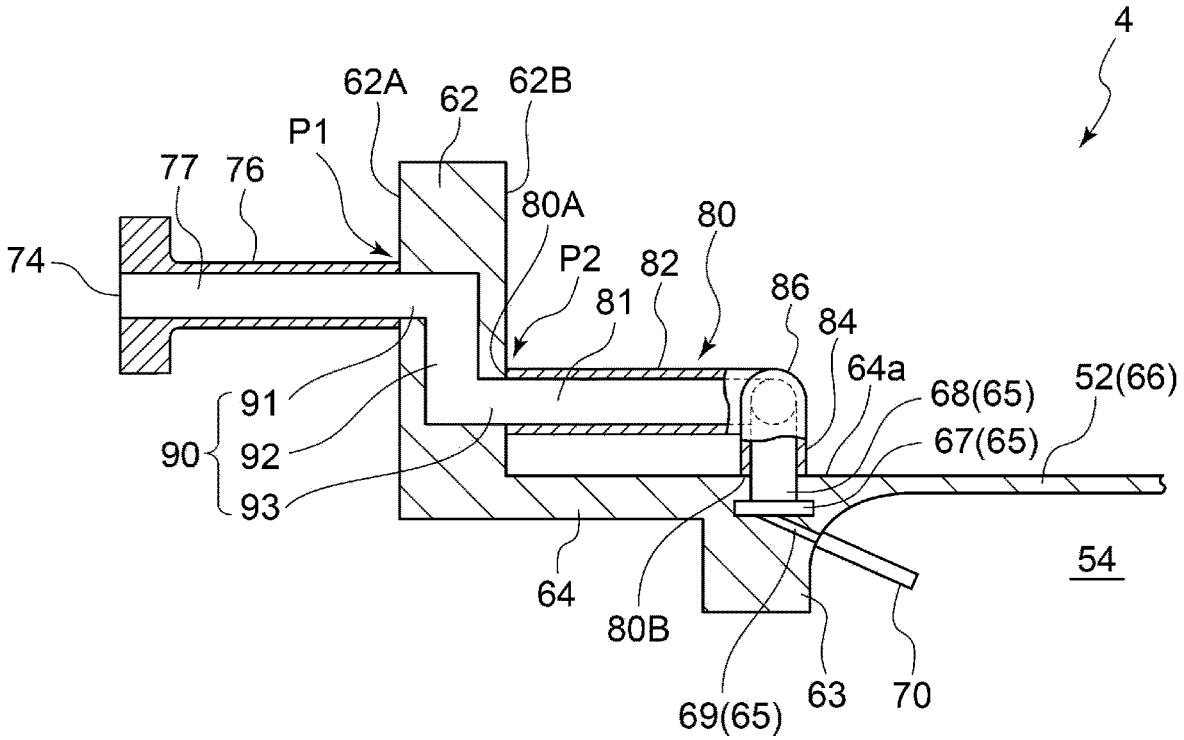
FIG. 5 is a partial cross-sectional view of a combustor according to an embodiment.

FIGS. 4 and 5 are each a partial cross-sectional view of the combustor 4 according to an embodiment. As depicted in FIGS. 4 and 5, the combustor 4 includes a flange portion 62 mounted to the casing 20, an extension portion 64 having an annular shape and extending in the axial direction of the combustor 4 from the flange portion 62, and a pipe portion 80 extending between the flange portion 62 and the extension portion 64. Furthermore, the fuel from the third fuel port 74 is supplied to the third fuel nozzle 70 ("fuel nozzle") via the pipe portion 80 and a passage 65 formed inside the extension portion 64.

As depicted in FIGS. 4 and 5, the flange portion 62 has a shape that protrudes outward in the radial direction of the combustor 4 (hereinafter, also referred to as merely "radial direction"), and is fixed to the casing 20 by a bolt 59.

The extension portion 64 has a cylindrical shape that extends along the axial direction of the combustor 4 toward the internal space of the casing 20 from the flange portion 62. In the illustrative embodiment depicted in FIGS. 4 and 5, the extension portion 64 is positioned at the inner side of the casing 20 in the radial direction. Furthermore, the extension portion 64 has an annular protruding portion 63 that protrudes inward in the radial direction. The wall surface portion 53 that changes the direction of the flow of compressed air flowing through the above described air passage 54 is formed by the annular protruding portion 63.

A passage 65 for letting the fuel to pass is disposed inside the extension portion 64. The passage 65 includes an annular passage 67 formed along the circumferential direction of the combustor 4, and the first connection passage 68 and the second connection passage 69 connected to the annular passage 67.

The first connection passage 68 is disposed between the fuel passage 81 formed by the pipe portion 80 (the inner flow passage of the pipe portion 80) and the annular passage 67, such that the fuel passage 81 of the pipe portion 80 and the annular passage 67 are in communication via the first connection passage 68. The second connection passage 69 is disposed between the annular passage 67 and the third fuel nozzle 70. In the illustrative embodiment depicted in FIGS. 4 and 5, the first connection passage 68 is positioned at the outer side of the annular passage 67 in the radial direction, and the second connection passage 69 is positioned at the inner side of the annular passage 67 in the radial direction.

Furthermore, in a case where the combustor 4 has a plurality of third fuel nozzles 70, the second connection passage 69 is provided for each of the plurality of third fuel nozzles 70.

The pipe portion 80 depicted in FIGS. 4 and 5 has the first end 80A connected to the flange portion 62 and the second end 80B connected to the outer peripheral surface 64*a* of the extension portion 64. The pipe portion 80 extends from the first end 80A to the second end 80B at the outer side of the extension portion 64 in the radial direction. The first end 80A of the pipe portion 80 is connected to an end surface 62B of the flange portion 62. The end surface 62B is one of the opposite end surfaces 62A, 62B of the flange portion 62 in the axial direction of the combustor 4.

The first end 80A of the pipe portion 80 is connected to the flange portion 62 typically by welding, and the second end 80B of the pipe portion 80 is connected to the extension portion 64 typically by welding.

Of the opposite end surfaces 62A, 62B of the flange portion 62, the fuel supply pipe 76 is connected to the end surface 62A that is opposite to the pipe portion 80. Furthermore, a flange internal passage 90 is formed inside the flange portion 62, such that the fuel passage 77 formed by the fuel supply pipe 76 and the fuel passage 81 formed by the pipe portion 80 (i.e., the inner flow passage of the pipe portion 80) are in communication with one another via the flange internal passage 90.

Accordingly, the fuel from the third fuel port 74 is supplied to the third fuel nozzle 70 via the fuel passage 77, the flange internal passage 90, the fuel passage 81, and the passage 65 disposed in the extension portion 64 (that is, the first connection passage 68, the annular passage 67, and the second connection passage 69).

Furthermore, the third fuel nozzle 70 is disposed at the inner peripheral side of the extension portion 64. Thus, the fuel from the pipe portion 80 disposed at the outer peripheral side of the extension portion 64 passes through the inside of the extension portion 64 from the outer peripheral side toward the inner peripheral side of the extension portion 64, and is supplied to the third fuel nozzle 70.

Furthermore, in a case where the combustor 4 has a plurality of third fuel nozzles 70, the fuel is supplied to the third fuel nozzle 70 corresponding to one of the plurality of second connection passages 69 through the corresponding second connection passage 69.

During operation of the gas turbine 1, heat expansion occurs in each constituent member. However, in the combustor 4 having the above described configuration, heat expansion occurs in different amounts between the pipe portion 80 and the extension portion 64. That is, the extension portion 64 is disposed in the casing 32 (space surrounded by the casing 20) whose temperature rises high during operation of the gas turbine 1, and thus the temperature of the extension portion 64 increases too, which causes the heat expansion amount to be relatively large. In contrast, as for the pipe portion 80, a fuel having a relatively low temperature passes through the fuel passage 77 disposed inside the pipe portion 80 during operation of the gas turbine 1, and thus the temperature of the pipe portion 80 is relatively low compared to that of the extension portion 64, which causes the heat expansion amount to be relatively small. When the heat expansion amounts are different between the pipe portion 80 and the extension portion 64 as described above, stress may be generated at the connection part (e.g., welding part) between the pipe portion 80 and the extension portion 64 due to the difference in the heat expansion amounts.

In this regard, according to the above described embodiment, the fuel is supplied to the third fuel nozzle 70 via the pipe portion 80 connected to the flange portion 62 and the extension portion 64, and thus it possible to reduce stress applied to the connection part (e.g. welding part) between the pipe portion 80 and the extension portion 64 even when stress is generated at the above described connection part due to different heat expansion amounts between the pipe portion 80 and the extension portion 64 during operation of the gas turbine 1, because the pipe portion 80 is relatively easily deformable. Thus, in the combustor 4 of the gas turbine 1, it is possible to mitigate stress concentration due to heat expansion, with a simple configuration in which the pipe portion 80 connected to the flange portion 62 and the extension portion 64 is provided. Accordingly, it is possible to reduce the machining cost and extend the lifetime of the combustor 4.

In a typical embodiment, as depicted in FIG. 3 for instance, the pipe portion 80 is disposed inside the space (combustor casing 32) surrounded by the casing 20 at the outer peripheral side of the extension portion 64.

As described above, during operation of the gas turbine 1, while the temperature of the space surrounded by the casing 20 increases, the temperature of the pipe portion 80 is maintained relatively low, because a fuel having a relatively low temperature passes through the inside of the pipe portion 80 even in a case where the pipe portion 80 is disposed inside the space. Thus, the heat expansion amount may be different between the pipe portion 80 and the extension portion 64, and thereby stress may occur at the connection part between the pipe portion 80 and the extension portion 64. However, as described above, since the pipe portion 80 is relatively easily deformable, it is possible to reduce the above described stress. Thus, it is possible to mitigate stress concentration due to heat expansion.

In the illustrative embodiment depicted in FIG. 4, the fuel supply pipe 76 extends along the axial direction. The first end 80A of the pipe portion 80 is positioned on the extension line of the center axis $C_2$ of the fuel supply pipe 76 and the flange internal passage 90 extends along the axial direction between the fuel supply pipe 76 and the first end 80A of the pipe portion 80. That is, the fuel supply pipe 76, the flange internal passage 90, and the first end 80A of the pipe portion 80 are arranged along a line parallel to the axial direction.

According to the above described embodiment, the fuel passage 77 inside the fuel supply pipe 76, the flange internal passage 90, and the fuel passage 81 including a part of the pipe portion 80 at the side of the first end 80A are arranged linearly, and thus it is possible to transfer the fuel via the above passages smoothy. Furthermore, the flange internal passage 90 extends along the axial direction, and thus the temperature distribution in the thickness direction of the flange portion 62 is almost uniform. Thus, it is possible to reduce thermal stress that may occur due to temperature distribution at the flange portion 62.

In the illustrative embodiment depicted in FIG. 5, the fuel supply pipe 76 is connected to the flange portion 62 at the connection position $P_1$ that is offset from the first end 80A of the pipe portion 80 in the radial direction of the combustor 4. The flange internal passage 90 includes a radial-direction passage 92, the first axial-direction passage 91, and the second axial-direction passage 93. The radial-direction passage 92 extends along the radial direction in the region between the connection position $P^1$ and the first end 80A in the radial direction. The first axial-direction passage 91 extends along the axial direction so as to connect the fuel passage 77 inside the fuel supply pipe 76 and the upstream end of the radial-direction passage 92. The second axial-direction passage 93 extends along the axial direction so as to connect the downstream end of the radial-direction passage 92 and the fuel passage 81 inside the pipe portion 80.

According to the above described embodiment, in a case where the connection position $P^1$ of the fuel supply pipe 76 and the connection position $P_2$ of the pipe portion 80 at the flange portion 62 are offset in the radial direction due to arrangement with other members, for instance, it is possible to supply the fuel supplied from the fuel supply pipe 76 to the third fuel nozzle 70 via the fuel passage including the radial-direction passage 92 disposed in the flange portion 62 and the fuel passage 81 of the pipe portion 80.

In some embodiments, as depicted in FIG. 3 for instance, the third fuel nozzle 70 is formed inside the casing 20, and is configured to inject the fuel into the air passage 54 which lets through air for combustion of the fuel.

In a typical combustor 4 (see FIG. 3 for instance), the air passage 54 is disposed at the relatively outer peripheral side, in the internal space of the casing 20 of the combustor 4. That is, the air passage 54 and the third fuel nozzle 70 for supplying the fuel to the air passage 54 are positioned relatively close to the flange portion 62 fixed to the casing 20, in the radial direction of the combustor 4. In this regard, according to the above described embodiment, it is possible to supply the fuel to the third fuel nozzle 70 positioned relatively close to the flange portion 62 via the pipe portion 80 connected to the flange portion 62, and thus it is possible to simplify the fuel supply path to the third fuel nozzle 70 and supply the fuel to the third fuel nozzle 70 smoothly.

As depicted in FIG. 3, the air passage 54 may be formed at least partially by the extension portion 64. That is, the extension portion 64 may include an air passage forming portion 66 (external cylinder 52) that forms the air passage 54 at the opposite side of the flange portion 62 across the pipe portion 80, in the axial direction of the combustor 4.

According to the above described embodiment, the air passage 54 is formed by a part of the extension portion 64, and thereby the third fuel nozzle 70 is disposed close to the extension portion 64. Thus, it is possible to supply the fuel to the fuel nozzle smoothly via the passage formed inside the extension portion.

Figure 6A:
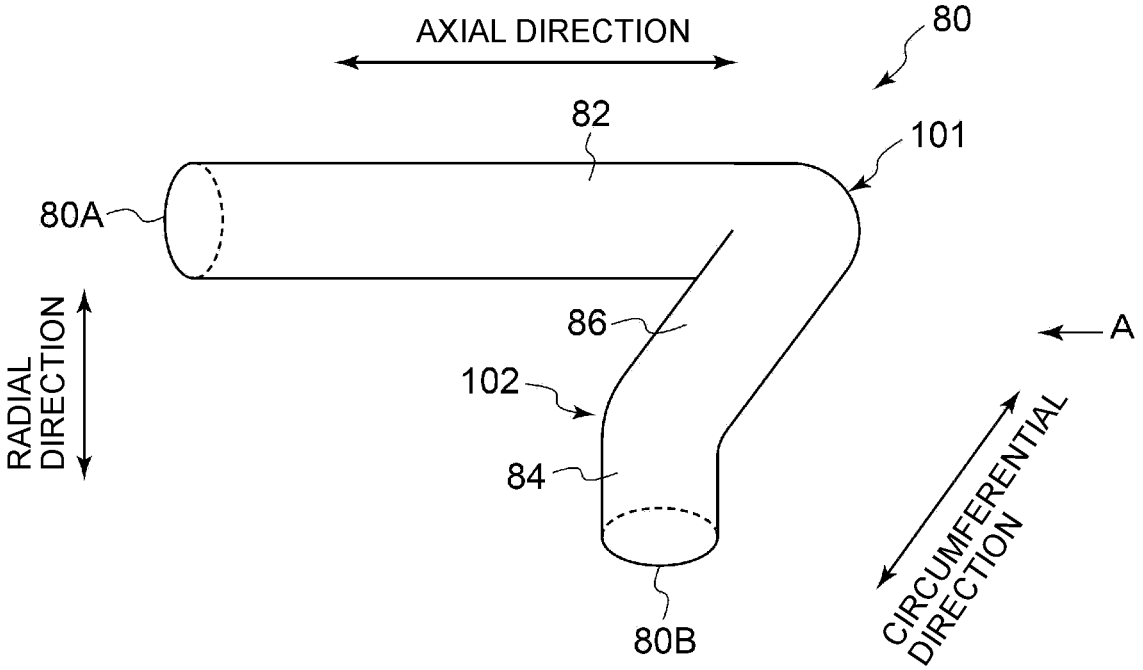
FIG. 6A is a perspective view of a pipe portion of a combustor according to an embodiment.
Figure 6B:
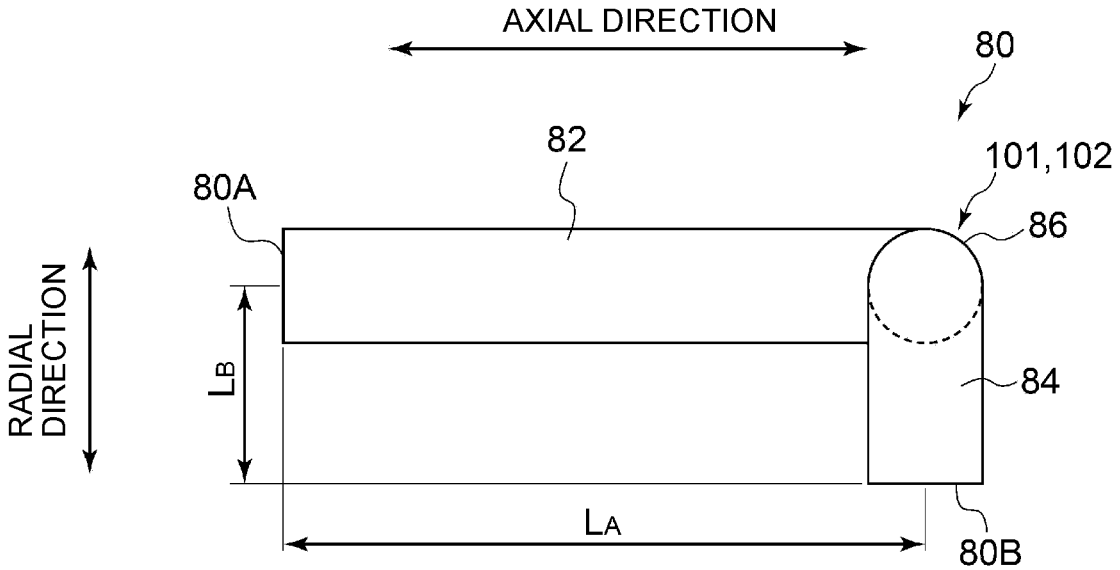
FIG. 6B is a side view of the pipe portion depicted in FIG. 6A.
Figure 6C:
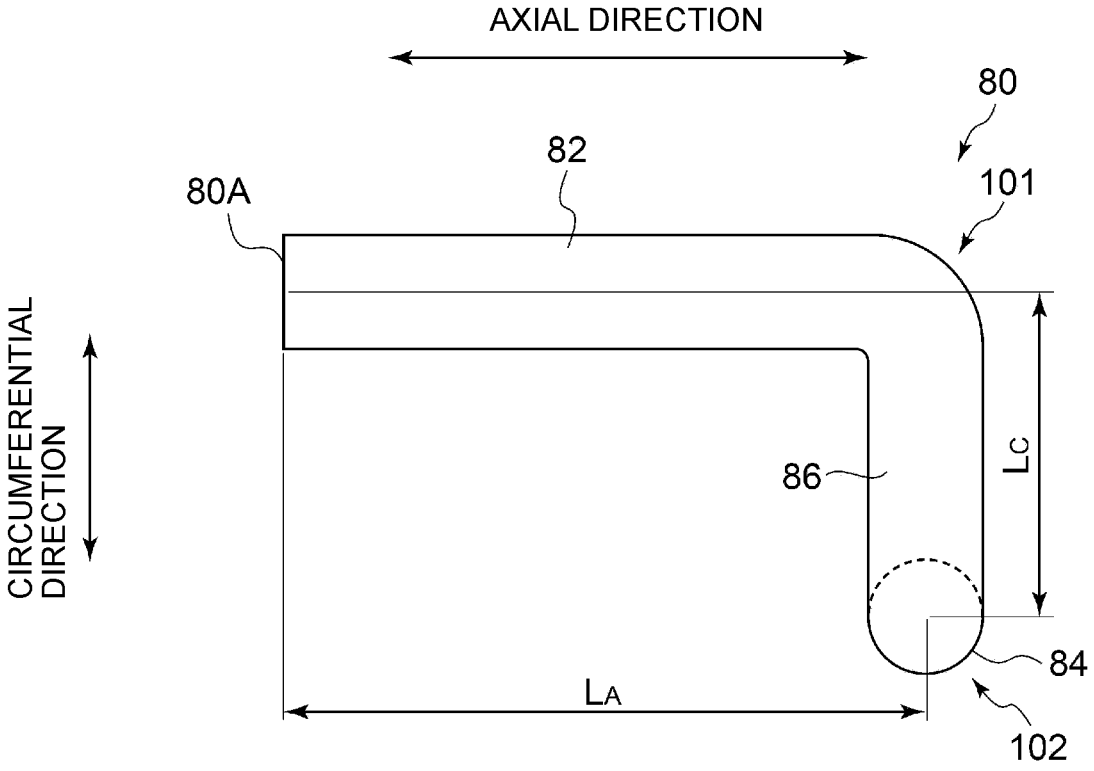
FIG. 6C is a planar view of the pipe portion depicted in FIG. 6A.
Figure 6D:
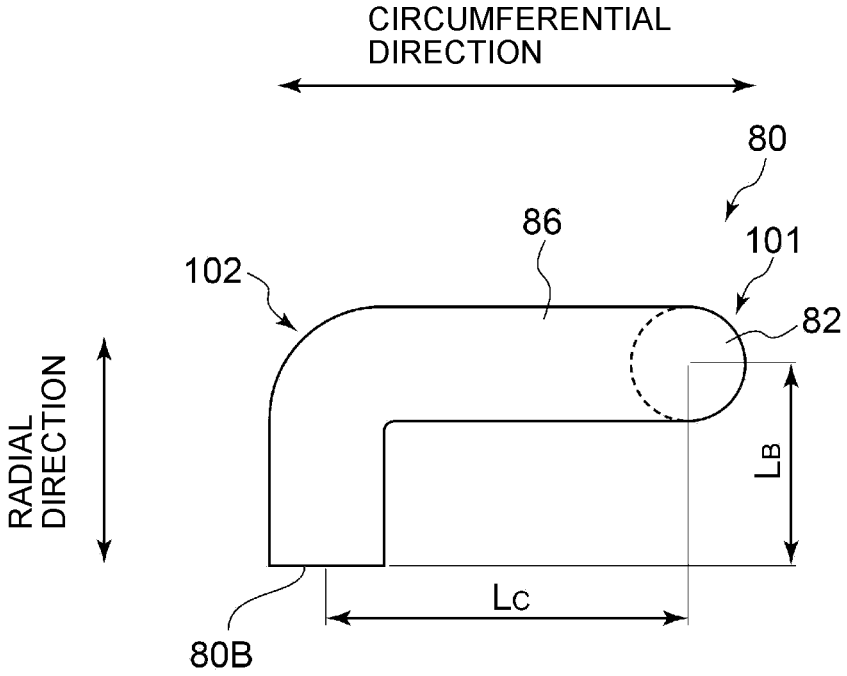
FIG. 6D is a view, seen in the direction of arrow A in FIG. 6A, of the pipe portion depicted in FIG. 6A.

Next, with reference to FIGS. 6A to 6D, the pipe portion 80 according to some embodiments will be described. FIG. 6A is a perspective view of the pipe portion 80 according to an embodiment. FIG. 6B is a side view (seen along the circumferential direction) of the pipe portion 80 depicted in FIG. 6A. FIG. 6C is a planar view (seen from the outer side toward the inner side in the radial direction) of the pipe portion 80 depicted in FIG. 6A. FIG. 6D is a view, seen in the direction of arrow A in FIG. 6A, of the pipe portion depicted in FIG. 6A.

In some embodiments, as depicted in FIGS. 6A to 6D for instance, the pipe portion 80 includes the first end 80A, an axial-direction pipe portion 82 extending along the axial direction of the combustor 4, the second end 80B, a radial-direction pipe portion 84 extending along the radial direction of the combustor 4, and a connection pipe portion 86 connecting the axial-direction pipe portion 82 and the radial-direction pipe portion 84. Furthermore, the length L of the pipe portion 80 including the connection pipe portion 86 is greater than the sum of the axial-direction distance $L_A$ between the first end 80A and the second end 80B and the radial-direction distance $L_B$ between the first end 80A and the second end 80B.

For instance, the pipe portion 80 depicted in FIGS. 6A and 6B includes a bend portion 101 that bends at the opposite end portion of the axial-direction pipe portion 82 from the first end 80A and a bend portion 102 that bends at the opposite end portion of the radial-direction pipe portion 84 from the second end 80B. The connection pipe portion 86 extends along the circumferential direction between the bend portion 101 and the bend portion 102. Furthermore, the length L ($=L_A+L_B+L_C$) of the pipe portion 80 is greater than the sum of the axial-direction distance $L_A$ between the first end 80A and the second end 80B and the radial-direction distance $L_B$ between the first end 80A and the second end 80B by the length of the connection pipe portion 86 (e.g., the length $L_C$ in the diagram).

Furthermore, the axial-direction distance $L_A$ between the first end 80A and the second end 80B may be the axial-direction distance between the center of the first end 80A and the center of the second end 80B. The radial-direction distance $L_B$ between the first end 80A and the second end 80B may be the radial-direction distance $L_B$ between the center of the first end 80A and the center of the second end 80B. The length L of the pipe portion 80 including the connection pipe portion 86 may be the length of the center line of the pipe portion 80.

That is, according to some embodiments, the length L of the center line of the pipe portion 80 including the connection pipe portion 86 is greater than the sum of the axial-direction distance $L_A$ between the center of the first end 80A and the center of the second end 80B and the radial-direction distance $L_B$ between the center of the first end 80A and the center of the second end 80B.

In a case where the length L of the pipe portion 80 including the connection pipe portion 86 is greater than the sum of the axial-direction distance $L_A$ and the radial-direction distance $L_B$ as described above, the pipe portion 80 has a shape that bends between the axial-direction pipe portion 82 connected to the flange portion 62 and the radial-direction pipe portion 84 connected to the extension portion 64, instead of a shape in which the axial-direction pipe portion 82 and the radial-direction pipe portion 84 are simply connected. Since the pipe portion 80 having the above described bend shape is flexibly deformable, it is possible to effectively reduce stress generated at the connection part between the pipe portion 80 and the extension portion 64 due to the difference in the heat expansion amounts between the pipe portion 80 and the extension portion 64.

Furthermore, while the connection pipe portion 86 of the pipe portion 80 depicted in FIGS. 6A to 6D has a linear shape extending along the circumferential direction, the shape of the connection pipe portion 86 is not limited to such a linear shape. For instance, the connection pipe portion 86 may be a shape in which a plurality of straight lines are connected such as an L shape, or a shape that includes curves.

In some embodiments, as depicted in FIGS. 6A to 6D for instance, the first end 80A and the second end 80B of the pipe portion 80 are positioned offset in the circumferential direction of the combustor 4.

In the above described embodiment, the first end 80A and the second end 80B of the pipe portion 80 are positioned offset in the circumferential direction, and thus the pipe portion 80 has a part that extends along the circumferential direction (in FIGS. 6A to 6D, the connection pipe portion 86) between the first end 80A and the second end 80B. Thus, it is possible to permit the pipe portion 80 to deform flexibly without extending the entire length of the pipe portion 80 excessively, which makes it is possible to effectively reduce stress generated at the connection part between the pipe portion and the extension portion due to the difference in the heat expansion amounts between the pipe portion 80 and the extension portion.

In some embodiments, as depicted in FIGS. 4 and 5 for instance, the second end 80B of the pipe portion 80 is positioned in the extension region of the annular passage 67 in the axial direction of the combustor 4.

In this case, the second end 80B of the pipe portion 80 connected to the extension portion 64 is positioned in the extension region of the annular passage 67 formed in the extension portion 64 in the axial direction of the combustor 4, and thus it is possible to shorten the distance between the second end 80B of the pipe portion 80 and the annular passage 67. Thus, it is possible to simplify the structure of the fuel passage (the first connection passage 68 in FIGS. 4 and 5) from the second end 80B to the annular passage 67, and easily provide a fuel passage for the pipe portion 80 by machining.

Figure 7:
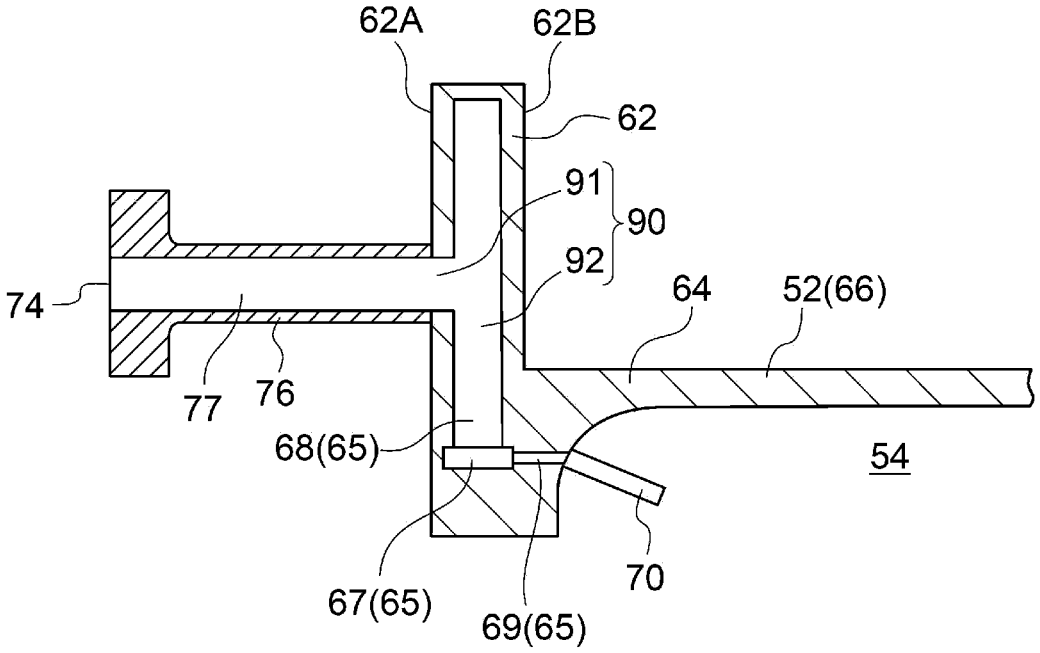
FIG. 7 is a partial cross-sectional view of a combustor according to an embodiment.
Figure 8:
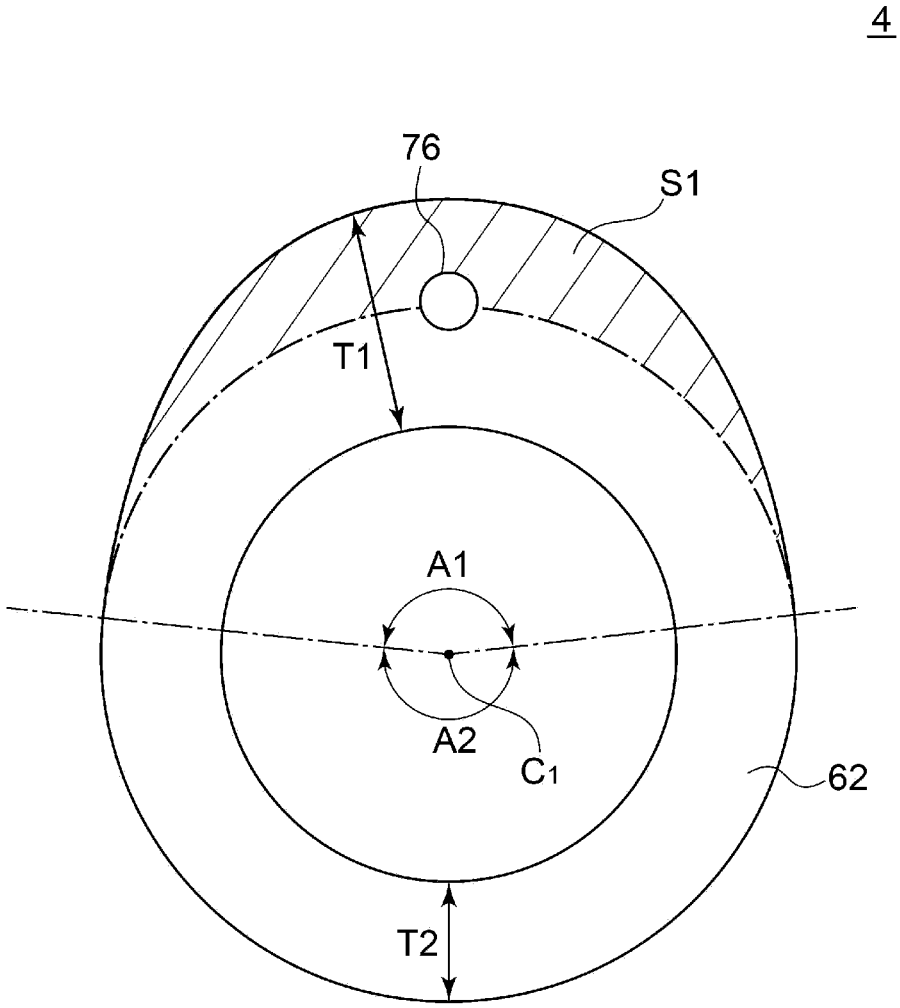
FIG. 8 is a schematic view of the flange portion of the combustor depicted in FIG. 7 as seen in the axial direction.

FIG. 7 is a partial cross-sectional view of the combustor 4 according to an embodiment. FIG. 8 is a schematic view of the flange portion 62 of the combustor 4 depicted in FIG. 7 as seen in the axial direction.

As depicted in FIG. 7, the combustor 4 includes a flange portion 62 mounted to the casing 20, an extension portion 64 having an annular shape and extending in the axial direction of the combustor 4 from the flange portion 62, and a fuel supply pipe 76 connected to the flange portion 62. Furthermore, the fuel from the third fuel port 74 is supplied to the third fuel nozzle 70 ("fuel nozzle") via the fuel passage formed by the fuel supply pipe 76 and a passage 65 formed inside the extension portion 64.

In the embodiment depicted in FIG. 7, the features common to the embodiment depicted in FIGS. 4 and 5 have been already described. Thus, in the following description, only the features that are different from FIGS. 4 and 5 will be described.

In the illustrative embodiment depicted in FIG. 7, as depicted in FIG. 8, the flange portion 62 has, in the first angular range A1 around the center axis $C_1$ of the combustor 4, the first region S1 (shaded area in FIG. 8) where the protruding amount toward the outer side in the radial direction is greater than that in the second angular range A2 other than the first angular range A1. That is, in FIG. 8, the protruding amount T1 of the flange portion 62 in the first region S1 is greater than the protruding amount T2 of the flange portion 62 in the second angular range A2. Herein, the protruding amount of the flange portion 62 is the distance between the inner peripheral edge and the outer peripheral edge of the flange portion 62 in the radial direction.

Thus, as depicted in FIG. 8, the fuel supply pipe 76 is connected to a part of the flange portion 62 that includes the above described first region S1.

In the above described embodiment, the flange portion 62 has the first region S1 with a relatively large protruding amount and the fuel supply pipe 76 is connected to the first region S1. Thus, it is possible to suppress an increase in the outer diameter of the gas turbine 1, compared to a case where the fuel is supplied to the flange internal passage 90 or the passage inside the extension portion 64 via the pipe or the like disposed at the outer side of the flange portion 62 in the radial direction. Furthermore, by providing the first region S1 where the protruding amount is large, it is possible to connect the fuel supply pipe 76 to the flange portion 62 without interfering with constituent members which may be disposed at the inner side of the combustor 4 in the radial direction (a part of the flange portion 62 where the protruding amount is not increased). Thus, it is possible to avoid interference between the fuel supply pipe 76 and other members without increasing the outer diameter of the gas turbine 1.

Furthermore, in the illustrative embodiment depicted in FIG. 7, the flange internal passage 90 includes the first axial-direction passage 91 extending in the axial direction, and the radial-direction passage 92 extending in the radial direction between the downstream end of the first axial-direction passage 91 and the first connection passage 68 of the extension portion 64. The radial-direction passage 92 of the flange portion and the first connection passage 68 of the extension portion 64 are connected directly.

Accordingly, the fuel is supplied to the third fuel nozzle 70 via the fuel passage 77 of the fuel supply pipe 76, the flange internal passage 90 (the first axial-direction passage 91 and the radial-direction passage 92), and the passage 65 of the extension portion 64 (the first connection passage 68, the annular passage 67, and the second connection passage 69).

The radial-direction passage 92 may extend further outward from the fuel supply pipe 76 in the radial direction.

In some embodiments, the first region S1 of the flange portion 62 is positioned farther away from the center axis O of the gas turbine 1 than the center axis $C_1$ of the combustor 4.

Or, the first region S1 of the flange portion 62 is positioned at the outer side of the center axis $C_1$ of the combustor 4 in the radial direction of the gas turbine 1.

According to the above described embodiment, of the flange portion 62, the first region S1 having a relatively large protruding amount is positioned at the outer side of the gas turbine 1 in the radial direction, and thus it is possible to suppress an increase in the outer diameter of the gas turbine 1 effectively. Thus, it is possible to avoid interference between the fuel supply pipe 76 and other members without increasing the outer diameter of the gas turbine 1.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Gas turbine
2 Compressor
4 Combustor
6 Turbine
8 Rotor
10 Compressor casing
12 Inlet
16 Stator vane
18 Rotor blade
20 Casing
22 Turbine casing
24 Stator vane
26 Rotor blade
28 Combustion gas passage
30 Exhaust chamber

31 Casing inlet
32 Combustor casing
36 Combustion cylinder
38 First combustion burner
40 First fuel nozzle
41 First burner cylinder
42 First fuel port
43 Second fuel port
44 Second combustion burner
46 Second fuel nozzle
47 Second burner cylinder
48 Combustor basket
49 Swirler
50 Transition piece
51 Outlet portion
52 External cylinder
53 Wall surface portion
54 Air passage
59 Bolt
62 Flange portion
62A, 62B End surface
63 Annular protruding portion
64 Extension portion
64*a* Outer peripheral surface
65 Passage
66 Air passage forming portion
67 Annular passage
68 First connection passage
69 Second connection passage
70 Third fuel nozzle
74 Third fuel port
76 Fuel supply pipe
77 Fuel supply pipe
80 Pipe portion
80A First end
80B Second end
81 Fuel passage
82 Axial-direction pipe portion
84 Radial-direction pipe portion
86 Connection pipe portion
90 Flange internal passage
91 First axial-direction passage
92 Radial-direction passage
93 Second axial-direction passage
101, 102 Bend portion
$A_1$ First angular range
$A_2$ Second angular range
$C_1$ Center axis of combustor
O Center axis of gas turbine
P1, P2 Connection position
S1 First region

The invention claimed is:

1. A combustor for a gas turbine, comprising:

a flange portion to be mounted to a casing;

an extension portion having an annular shape and extending from the flange portion along an axial direction of the combustor;

a pipe portion having a first end connected to the flange portion and a second end connected to an outer peripheral surface of the extension portion, the pipe portion extending from the first end to the second end at an outer side of the extension portion in a radial direction; and at least one fuel nozzle configured to receive supply of a fuel via the pipe portion and a passage disposed inside the extension portion, wherein the pipe portion includes:

an axial-direction pipe portion including the first end and extending along the axial direction of the combustor;

a radial-direction pipe portion including the second end and extending along a radial direction of the combustor; and a connection pipe portion connecting the axial-direction pipe portion and the radial-direction pipe portion, and wherein the pipe portion has a length L including the connection pipe portion, the length L being larger than a sum of LA and LB, where LA is an axial-direction distance between the first end and the second end and LB is a radial-direction distance between the first end and the second end.

2. The combustor for a gas turbine according to claim 1, wherein the passage includes an annular passage communicating with an inner flow passage of the pipe portion, and wherein the combustor is configured such that the fuel is supplied to a plurality of the fuel nozzles via the annular passage.

3. The combustor for a gas turbine according to claim 1, wherein the at least one fuel nozzle is disposed at an inner peripheral side of the extension portion.

4. The combustor for a gas turbine according to claim 1, wherein the fuel nozzle is formed inside the casing, and configured to inject a fuel into an air passage through which air to be used in combustion of the fuel passes.

5. The combustor for a gas turbine according to claim 4, wherein the extension portion includes an air-passage forming portion which forms the air passage at an opposite side of the flange portion across the pipe portion in the axial direction.

6. The combustor for a gas turbine according to claim 1, wherein the at least one fuel nozzle is formed inside the casing and configured to inject the fuel into an air passage through which air to be used in combustion passes and generate a fuel-gas mixture of the air and the fuel, and wherein the combustor further includes a downstream nozzle disposed at a downstream side in a flow direction of the fuel gas mixture and configured to inject the fuel to the fuel gas mixture.

7. A gas turbine, comprising:

the combustor according to claim 1; and a stator vane and a rotor blade disposed at a downstream side of the combustor.

8. The combustor for a gas turbine according to claim 1, wherein the pipe portion has an inner flow passage formed inside the pipe portion so as to extend between the first end and the second end, and wherein the inner flow passage of the pipe portion is in communication with a passage inside the extension portion for allowing the fuel to pass through toward the at least one fuel nozzle.

9. A combustor for a gas turbine, comprising:

a flange portion to be mounted to a casing;

an extension portion having an annular shape and extending from the flange portion along an axial direction of the combustor;

a pipe portion having a first end connected to the flange portion and a second end connected to an outer peripheral surface of the extension portion, the pipe portion extending from the first end to the second end at an outer side of the extension portion in a radial direction; and at least one fuel nozzle configured to receive supply of a fuel via the pipe portion and a passage disposed inside the extension portion, wherein the first end and the second end of the pipe portion are positioned offset from one another in a circumferential direction of the combustor.

10. The combustor for a gas turbine according to claim 1, wherein the pipe portion is disposed inside a space surrounded by the casing at an outer peripheral side of the extension portion.

11. A gas turbine comprising:

the combustor according to claim 9; and a stator vane and a rotor blade disposed at a downstream side of the combustor.

12. A combustor for a gas turbine, comprising:

a flange portion to be mounted to a casing;

an extension portion having an annular shape and extending from the flange portion along an axial direction of the combustor;

a pipe portion having a first end connected to the flange portion and a second end connected to an outer peripheral surface of the extension portion, the pipe portion extending from the first end to the second end at an outer side of the extension portion in a radial direction;

at least one fuel nozzle configured to receive supply of a fuel via the pipe portion and a passage disposed inside the extension portion; and a fuel supply pipe connected to an end surface opposite to the pipe portion, the end surface being one of two opposite end surfaces of the flange portion, wherein the combustor is configured such that the fuel is supplied to the passage inside the extension portion via the fuel supply pipe, a flange internal passage disposed inside the flange portion, and the pipe portion.

13. The combustor for a gas turbine according to claim 12, wherein the fuel supply pipe, the flange internal passage, and the first end of the pipe portion are disposed along a line substantially parallel to the axial direction of the combustor.

14. A gas turbine comprising:

the combustor according to claim 12; and a stator vane and a rotor blade disposed at a downstream side of the combustor.

15. A combustor for a gas turbine, comprising:

a flange portion to be mounted to a casing;

an extension portion having an annular shape and extending from the flange portion along an axial direction of the combustor;

at least one fuel nozzle configured to receive supply of a fuel via a passage disposed inside the extension portion;

and a fuel supply pipe for supplying the fuel to the passage, the fuel supply pipe being connected to the flange portion, wherein the flange portion has, in a first angular range around a center axis of the combustor, a first region whose protruding amount outward in a radial direction is greater than that in a second angular-range other than the first angular range, and wherein the fuel supply pipe is connected to an end surface of the flange portion opposite to the extension portion, the end surface being one of two opposite end surfaces of the flange portion, at a portion of the flange portion including the first region.

16. A gas turbine, comprising:

the combustor according to the claim 15; and a stator vane and a rotor blade disposed at a downstream side of the combustor, wherein the first region of the flange portion is disposed at a position farther away from a center axis of the gas turbine than the center axis of the combustor.

* * * * *